US007287498B2

(12) United States Patent
Suga et al.

(10) Patent No.: US 7,287,498 B2
(45) Date of Patent: Oct. 30, 2007

(54) VALVE TIMING CONTROL APPARATUS AND ITS ASSEMBLING METHOD

(75) Inventors: Seiji Suga, Kanagawa (JP); Tomoya Tsukada, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 62 days.

(21) Appl. No.: 11/213,925

(22) Filed: Aug. 30, 2005

(65) Prior Publication Data

US 2006/0042581 A1 Mar. 2, 2006

(30) Foreign Application Priority Data

Aug. 31, 2004 (JP) ..... 2004-252256

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS 6,595,173 B2 7/2003 Hori
2001/0039932 A1* 11/2001 Sekiya et al. ..... 123/90.17

FOREIGN PATENT DOCUMENTS

JP 3075337 6/2000
JP 2003-113703 A 4/2003
JP 2004-100574 4/2004

* cited by examiner

*Primary Examiner*—Zelalem Eshete
(74) *Attorney, Agent, or Firm*—Foley and Lardner LLP

(57) ABSTRACT

In valve control apparatus for an internal combustion engine and its assembling method, a positioning section is interposed between a predetermined position of a housing member at which a shoe is positioned so as to be opposed against a side surface of a vane in which a lock piston is arranged and one of a front cover and a rear plate on which a lock hole is formed, to perform a housing circumferential directional positioning of the lock piston and the lock hole.

19 Claims, 6 Drawing Sheets

VALVE TIMING CONTROL APPARATUS AND ITS ASSEMBLING METHOD

BACKGROUND OF THE INVENTION

1. Field of the Invention

The present invention relates to valve timing control apparatus which variably controls open and closure timings of an engine valve constituted by an intake valve or exhaust valve of an internal combustion engine in accordance with a driving condition of the engine and its assembling method.

2. Description of the Related Art

A Japanese Patent Application First Publication No. 2003-113703 published on Apr. 18, 2003 (which corresponds to a U.S. Pat. No. 6,595,173 issued on Jul. 22, 2003) exemplifies a previously proposed valve timing control apparatus. In the previously proposed valve timing control apparatus, a housing in which a cylindrical housing member and a front cover and a rear plate to enclose openings of both ends of the housing member are integrally coupled together by means of a plurality of bolts is provided, a vane member fixed to an end of a camshaft is rotatably housed within the housing and advance angle oil chambers and retardation angle oil chambers are formed on an inner peripheral surface of the housing and alternately among three shoes of approximately trapezoid shapes and mutually projected from a radial direction toward an inner direction. A sprocket to transmit a torque from a crankshaft via a timing chain is integrally formed on an outer peripheral surface side of the rear plate. In addition, a lock pin is retractably projected from a sliding hole formed in an inner axial direction of one of the vanes and a lock hole is engageably disengaged from the lock pin on the inner end surface of the rear plate. Then, a hydraulic pressure drained from an electric power pump which is driven to be rotated in normal and reverse directions is selectively supplied to either of the advance angle oil chambers or the retardation angle oil chambers so that the vane member is rotated in the normal or reverse direction and a relative pivotal phase between the timing pulley and the camshaft is varied. Thus, the open and the closure timings of the intake valve are variably controlled. Furthermore, during a stop of the engine, the lock pin is engaged into the lock plate so that a relative conversion angular position of the vane member to the housing is retained at an optimum position during the start of the engine to secure a favorable restart performance.

SUMMARY OF THE INVENTION

However, in the previously proposed valve timing control apparatus, when, during an assembly of each component of the valve timing control apparatus, the housing member, the rear plate in which the lock hole is provided, and the front cover are coupled through a joint fastening by a plurality of bolts, the bolts and bolt holes formed on the rear plate are mutually and slightly deviated in a circumferential direction of the housing. Consequently, there is a possibility that the position of the lock hole is deviated from a normal position. Hence, during the stop of the engine, it becomes difficult for the lock pin to be engaged with the lock hole at the lock position and there is a possibility that the vane member and the housing cannot be restrained.

It is, therefore, an object of the present invention to provide an improved valve timing control apparatus for an internal combustion engine and its assembly method which can accurately position each of components constituting the valve timing control apparatus during the assembly of the apparatus.

According to one aspect of the present invention, there is provided with a valve timing control apparatus for an internal combustion engine, comprising: a housing comprising a cylindrical housing member, a front cover, and a rear plate, both of the front cover and the rear plate enclosing openings of both ends of the housing member and being integrally coupled to the housing member by means of a plurality of fastening members to constitute the housing; a rotation transmitting member to transmit a torque from an engine crankshaft to the housing; at least one shoe projected from an inner peripheral surface of the housing member; a vane member rotatably arranged within the housing to partition an inner space of the housing into an advance angle oil chamber and a retardation angle oil chamber by means of at least one vane extended radially and the shoe; a seal member fitted into a seal groove formed on a tip surface of the vane and slidably contacted with the inner peripheral surface of the housing member; a hydraulic supply-and-exhaust mechanism to selectively supply and exhaust working oil to and from the advance angle oil chamber and the retardation angle oil chamber; a lock piston retractably projected from an inner part of the vane; a part of one of the front cover and the rear plate comprising a lock hole to restrain a relative rotation between the vane member and the housing when the lock piston is projected and is inserted into the lock hole; an engagement-and-disengagement mechanism that causes an engagement and a release of the engagement of the lock piston with the lock hole in accordance with an engine start; and a positioning section, interposed between a predetermined position of the housing member at which the shoe is positioned so as to be opposed against a side surface of the vane in which the lock piston is arranged and one of the front cover and rear plate on which the lock hole is formed, to perform a housing circumferential directional positioning of the lock piston and the lock hole, the positioning section comprising: a positioning convex portion installed on one of the front cover, the rear plate, and the housing member; and a positioning recess portion installed on one of the remaining two of the front cover, the rear plate, and the housing member to engage with the positioning convex portion to perform the housing circumferential positioning of the lock piston and the lock hole, a cutout portion being formed on at least a side surface of a tip portion of the vane in which the lock piston is installed opposed against the shoe, a raise portion being formed on a side portion of the shoe opposed against the cutout portion, one of the positioning convex portion and the positioning recess portion being installed on a side of the raise portion of the shoe of the housing member, and the other of the positioning convex portion and the positioning recess portion being installed on one of the front cover and the rear plate on which the lock hole is formed.

According to another aspect of the present invention, there is provided with a valve timing control apparatus for an internal combustion engine, comprising: a housing comprising a cylindrical housing member, a front cover, and a rear plate both of the front cover and the rear plate enclosing openings of both ends of the housing member and being integrally coupled to the housing member by means of a plurality of fastening members to constitute the housing; a rotation transmitting member to transmit a torque from an engine crankshaft to the housing; at least one shoe projected from an inner peripheral surface of the housing member; a vane member rotatably arranged within the housing to partition an inner space of the housing into an advance angle oil chamber and a retardation angle oil chamber by means of at least one vane extended radially and the shoe; a seal member fitted into a seal groove formed on a tip surface of the vane and slidably contacted with the inner peripheral surface of the housing member; a hydraulic supply-and-exhaust mechanism to selectively supply and exhaust working oil to and from the advance angle oil chamber and the retardation angle oil chamber; a lock piston retractably projected from an inner part of the vane; a part of one of the front cover and the rear plate comprising a lock hole to restrain a relative rotation between the vane member and the housing when the lock piston is projected and is inserted into the lock hole; an engagement-and-disengagement mechanism that causes an engagement and a release of the engagement of the lock piston with the lock hole in accordance with an engine start; and a positioning section, interposed between a predetermined position of the housing member at which the shoe is positioned so as to be opposed against a side surface of the vane in which the lock piston is arranged and one of the front cover and rear plate on which the lock hole is formed, to perform a housing circumferential directional positioning of the lock piston and the lock hole.

According to still another aspect of the present invention, there is provided with an assembling method for a valve timing control apparatus for an internal combustion engine, the valve timing control apparatus comprising: a housing comprising a cylindrical housing member, a front cover, and a rear plate, both of the front cover and the rear plate enclosing openings of both ends of the housing member and being integrally coupled to the housing member by means of a plurality of fastening members to constitute the housing; a rotation transmitting member to transmit a torque from an engine crankshaft to the housing; at least one shoe projected from an inner peripheral surface of the housing member; a vane member rotatably arranged within the housing to partition an inner space of the housing into an advance angle oil chamber and a retardation angle oil chamber by means of at least one vane extended radially and the shoe; a seal member fitted into a seal groove formed on a tip surface of the vane and slidably contacted with the inner peripheral surface of the housing member; a hydraulic supply-and-exhaust mechanism to selectively supply and exhaust working oil to and from the advance angle oil chamber and the retardation angle oil chamber; a lock piston retractably projected from an inner part of the vane; a part of one of the front cover and the rear plate comprising a lock holeto restrain a relative rotation between the vane member and the housing when the lock piston is projected and is inserted into the lock hole; an engagement-and-disengagement mechanism that causes an engagement and a release of the engagement of the lock piston with the lock hole in accordance with an engine start; and a positioning section, interposed between a predetermined position of the housing member at which the shoe is positioned so as to be opposed against a side surface of the vane in which the lock piston is arranged and one of the front cover and rear plate on which the lock hole is formed, to perform a housing circumferential directional positioning of the lock piston and the lock hole, the positioning section comprising: a first positioning recess portion installed on one of the front cover, the rear plate, and the housing member; and a second positioning recess section installed on one of the remaining two of the front cover, the rear plate, and the housing member so as to face toward the first positioning recess portion, a cutout portion being formed on a side surface of a tip portion of the vane in which the lock piston is installed which is faced toward the shoe, a raise portion being formed on the side surface of the tip portion of the shoe faced toward the cutout portion, one of the first and second positioning recess portions being installed on a side of the raise portion of the shoe of the housing member, and the other of the first and second positioning recess portions being installed on one of the front cover and the rear plate on which the lock hole is formed, the assembling method comprising: fitting a positioning jig into the first and second positioning recess portions to perform the housing circumferential positioning, during the assembly of the front cover and the rear plate onto the housing member; and removing the positioning jig from the first and second positioning recess portions after the assembly of the front cover and the rear plate onto the housing member is finished.

DETAILED DESCRIPTION OF THE INVENTION

Figure 1:
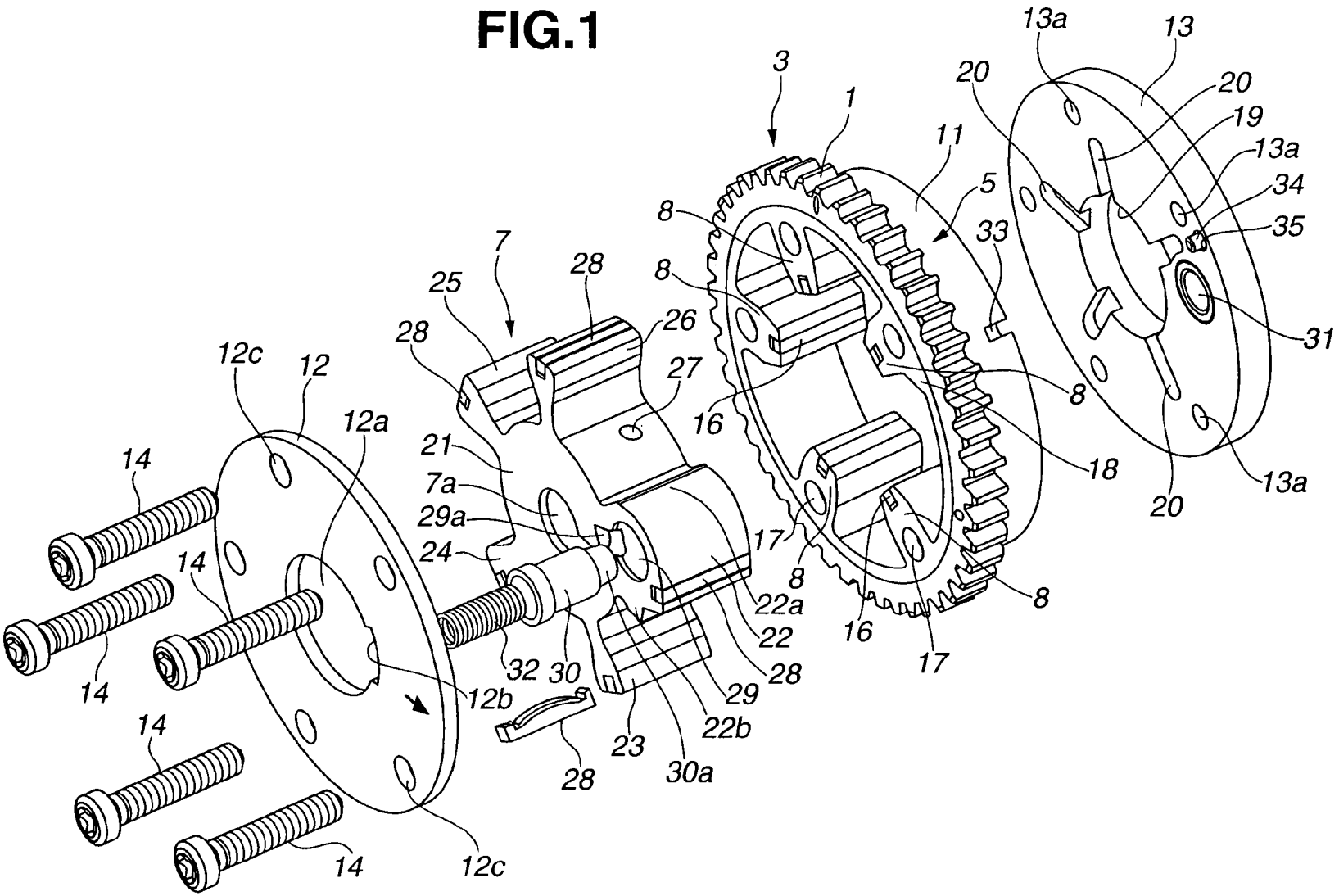
FIG. 1 is an exploded perspective view representing a first preferred embodiment of a valve timing control apparatus according to the present invention.

Reference will hereinafter be made to the drawings in order to facilitate a better understanding of the present invention.

FIGS. 1 through 5 show a first preferred embodiment of a valve timing control apparatus according to the present invention. That is to say, the valve timing control apparatus in the first embodiment includes: a sprocket 1 which is a rotation transmitting member, sprocket 1 being rotationally driven via a timing chain by a crankshaft of an engine; a camshaft 2 disposed to be relatively pivotable to sprocket 1; a phase conversion mechanism 3 disposed between sprocket 1 and camshaft 2 to convert a relative pivotal position between both of the sprocket 1 and camshaft 2; and a hydraulic circuit 4 which actuates phase conversion mechanism 3.

Camshaft 2 is rotatably supported via a cam bearing on a cylinder head (not shown). A plurality of drive cams to drivingly open an intake valve via a valve lifter are integrally installed on a predetermined position of an outer peripheral surface of camshaft 2. Then, a female screw hole 2*b* to which a cam bolt 6 as will be described later is screwed is formed in an inner axial direction of one end portion 2*a* of camshaft 2.

Phase conversion mechanism 3 is provided with a housing 5 disposed at one end portion of camshaft 2, a vane member 7 fixed at the one end portion of camshaft 2 by means of a cam bolt 6 axially and rotatably housed within housing 5, and five advance angle oil chambers 9 and five retardation angle oil chambers 10 partitioned by means of five shoes 8 and five vanes 22 through 26 of a vane member 7 attached onto an inner peripheral surface of housing 5 as will be described later.

Housing 5 includes: an approximately cylindrical housing member 11; and a front cover 12 and a rear plate 13 to enclose front and rear opening ends of housing member 11. Housing member 11, front cover 12, and rear plate 13 are integrally coupled by means of a joint fastening of five bolts 14 (fastening members) through an axial direction of housing member 11.

Sprocket 1 is integrally formed on an outer peripheral surface of housing member 11 and the whole part of sprocket 1 and housing member 11 are formed of a sintered alloy material. During this working, a heat treatment is made to be hardened to this sintered alloy material.

In addition, five shoes 8 are integrally projected toward a center of an inner space of housing member 11 on the inner peripheral surface of housing member 11 at approximately equal intervals in a circumferential direction of housing member 11. Each shoe 8 is formed with its side surfaces of substantially letter U shapes and a seal member 16 in a substantially letter U shape is fitted into a seal groove formed on a tip of each shoe 8 along the axial direction of housing member 11. A bolt penetrating hole 17 is penetrated through a bottom portion of each shoe 8 in the inner axial direction of housing member 11.

Figure 4:
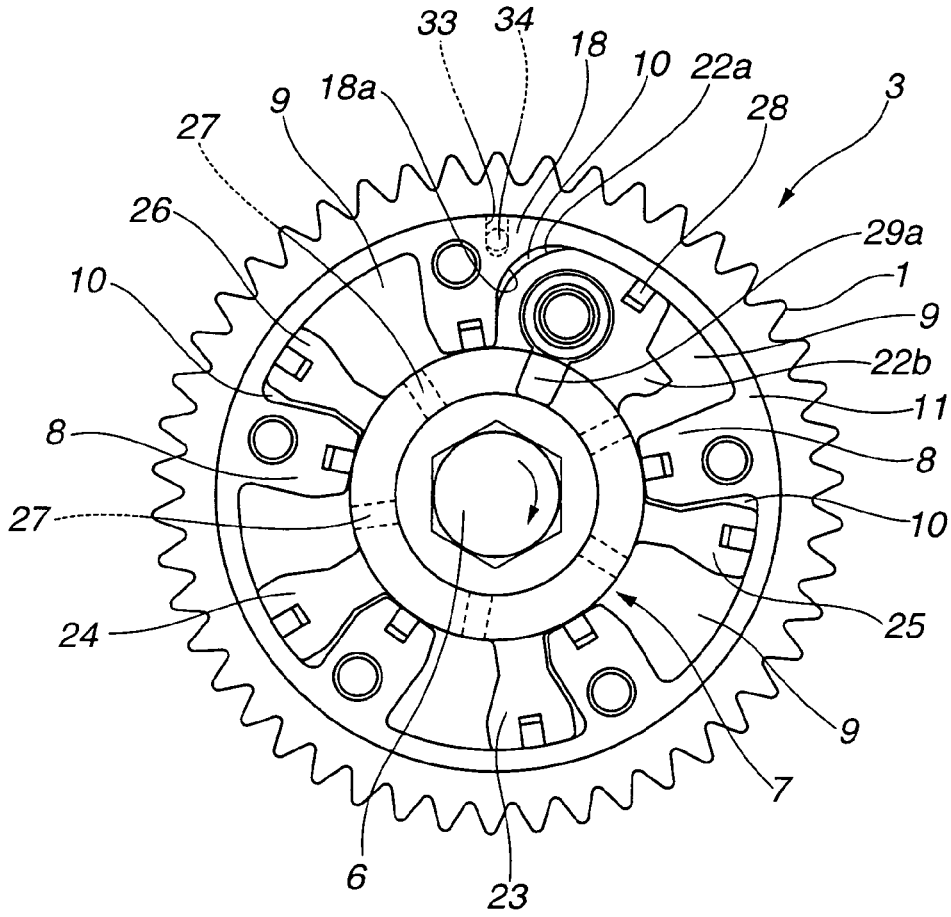
FIG. 4 is an explanatory view for explaining an action of the first embodiment in which the valve timing is controlled in an retardation angle direction.
Figure 5:
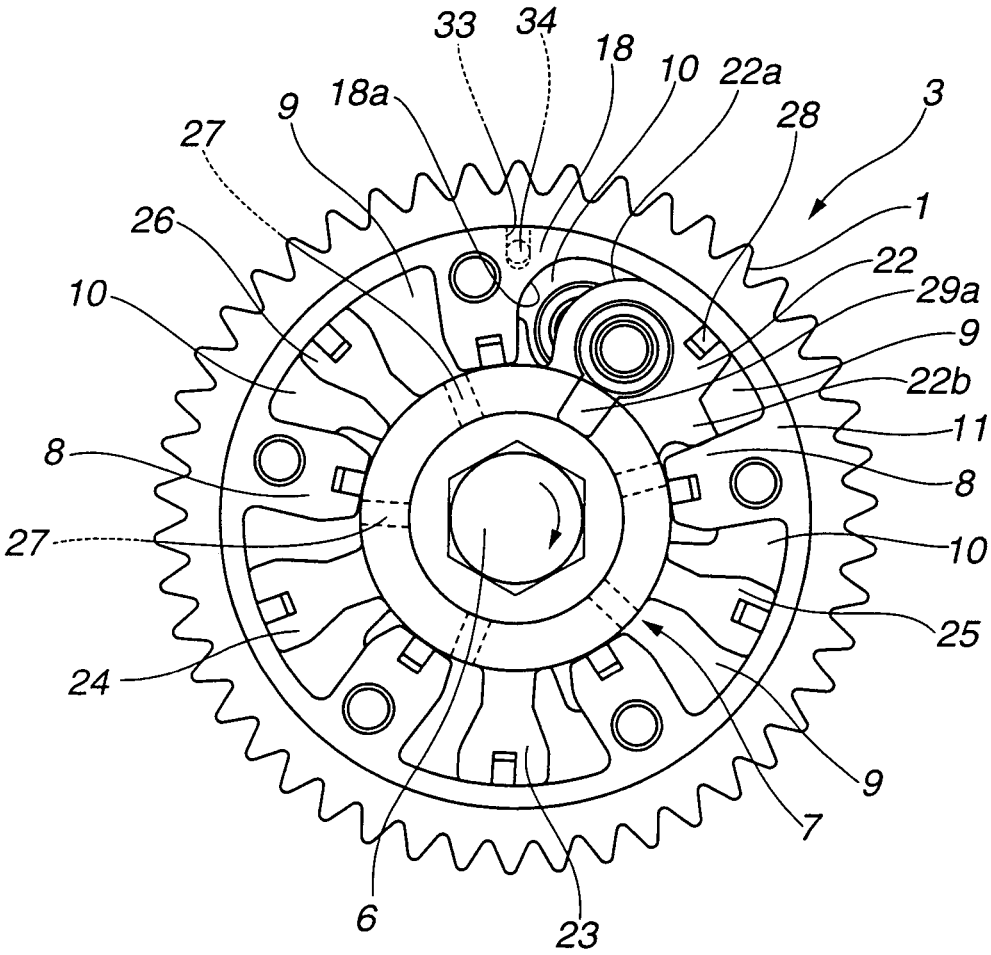
FIG. 5 is an explanatory view for explaining an action of the first embodiment in which the valve timing is controlled in an advance angle direction.

As typically shown in FIGS. 4 and 5, one of five shoes 8 has one side surface in the circumferential direction of the bottom portion thereof which is integrally formed with a raise portion 18. This raise portion 18 has its outer side surface 18*a* formed in an approximately arc shape. This raise portion 18 is formed by a gradual curved slope from a rising portion of the corresponding side surface along inner peripheral surface 11*a* of housing member 11.

Front cover 12 is formed in a relatively thin disc shape by means of a press forming. A large-diameter hole 12*a* through which cam bolt 6 is penetrated is formed at the center of front cover 12. An arc shaped cutout groove 12*b* is formed at a predetermined position of a hole edge of large-diameter hole 12*a*. Five bolt holes 12*c* through which respective bolts 14 are inserted are penetrated at equal intervals in the circumferential direction at the outer peripheral side of front cover 12.

Rear plate 13 is formed in a disc shape thicker than front cover 11 by means of the same (press) forming. A supporting hole 19 is penetrated through which one end 2*a* of camshaft 2 is inserted so as to enable one 2*a* of camshaft 2 to be rotatably supported. Five advance angle side oil grooves 20 are formed on an inner end surface of rear plate and extended radially from a hole edge of supporting hole 19 to communicate with respective advance angle oil chambers 10. In addition, female screw holes 13*a* which screws male screws at respective tips of respective bolts 14 are formed at equal interval poistions along a circumferential direction of rear plate 13.

Vane member 7 is integrally formed of a metal material. As typically shown in FIGS. 2 and 3, vane member 7 is constituted by a vane rotor 21 fixed onto one end 2*a* of camshaft 2 from the axial direction by means of cam bolt 6 inserted through the axial direction into a penetrating hole 7*a* and by five vanes 22 through 26 radially projected at substantially equal interval positions in the circumferential direction of an outer peripheral surface of vane rotor 21.

Vane rotor 21 sildes and are rotatably supported on seal members 16 fitted onto the upper surface of the tip portion of respective shoes 8. Five retardation angle oil holes 27 are penetrated and formed which communicate with respective retardation angle oil chambers 9 in the inner radial direction. In addition, a fitting groove 21*a* into which a tip of one end portion 2*a* of camshaft 2 is fitted is formed at a center of an end surface of camshaft 2.

Each vane 22 through 26 is arranged between each adjacent shoe 8. A seal member 28 of an approximately letter U shape is fitted into a seal groove formed on each tip surface of shoes 8 to be slidably contacted with inner peripheral surface 11*a* of housing member 11. In addition, a circumferential width of each vane 22 through 26 is mutually different from one another, as typically shown in FIGS. 4 and 5. First vane 22 is formed to have a maximum width, the widths of two sheets of vanes 23, 24 located at opposing positions in the radial direction to first vane 22 are set to intermediate lengths slightly shorter than first vane 22 having the maximum width, and other vanes 25, 26 positioned at both sides of first vane 22 have shorter widths than intermediate width vanes 23, 24. As described above, the widths of respective vanes 22 through 26 are respectively varied so that the whole weight balances of vane member 7 are uniformed.

A cutout portion 22*a* of first vane 22 having the maximum width is formed on a portion of first vane 22 which opposes against raise portion 18 formed on one of shoes 8. This cutout portion 22*a* is formed in an arc shape having the same curvature as arc shaped outer side surface 18*a* of raise portion 18. When vane member 7 is revolved in a maximum counter-clockwise direction as shown in FIG. 4, cutout portion 22*a* is faced against an outer side surface 18*a* of raise portion 18 with a slight arc shaped gap.

A substantially triangular projection portion 22*b* is integrally formed on a side surface of first vane 22 in an opposite side to cutout portion 22*a* of first vane 22 having the maximum width. This projection 22*b* has its tip edge of shoe 8 to limit the furthermore rotation of vane member 7 due to the contact of its tip edge of vane member 7 against the side surface of opposing shoe 8 when vane member 7 is revolved in the maximum clockwise direction so as to adjust a relative rotation conversion angle to housing 5.

A lock mechanism to constrain a free rotation of vane member 7 is interposed between vane 22 having the maximum width and rear plate 13. The lock mechanism includes: a lock piston 30 slidably housed within a sliding hole 29 formed so as to be penetrated in an inner axle direction of vane 22 and installed to enable advance and retraction (retractably projected) thereof with respect to rear plate 13; a lock hole 31 formed at a predetermined position in the circumferential direction of an inner end surface of rear plate 13 with which a tip portion 30*a* of lock piston 30 is advanced and engaged or from which the engaged top portion 30*a* is retracted and disengaged; and an engagement-and-disengagement mechanism which engages lock piston 30 into lock hole 31 and disengages lock piston 30 from lock hole 31 in accordance with a start state of the engine.

Lock piston 30 is formed in a cylindrical pin shape and has a tip portion 30*a* formed in a step difference shape and in an approximately circular truncated cone shape so as to enable an easy engagement within lock hole 31.

A cutout groove 29*a* in a rectangular shape is formed on a hole edge of front cover 12 of sliding hole 29 and this cutout groove 29*a* and cutout groove 12*b* of front cover 12 are always communicated with each other in a rotation range of vane member 7 so as to function as an air vent hole to secure a favorable slide motion of lock piston 30.

Lock hole 31 is formed in a bottom presence shape not penetrating through rear plate 13 and is formed at a position deviated toward the advance angle oil chamber side 10 in the circumferential direction, as shown in FIGS. 4 and 5. In a case where lock hole 31 is engaged with lock piston 30, the relative conversion angle between housing 5 and vane member 7 is set to be the position toward the retardation angle side.

The engagement-and-disengagement mechanism is resiliently installed between a rear end portion of lock piston 30 and an inner end portion of front cover 12 and includes a coil spring 32 to bias lock piston 30 in the advance (projection) direction; and a release (disengagement) purpose hydraulic (pressure) circuit which supplies the hydraulic pressure within lock hole 31 to retract lock piston 30. This release purpose hydraulic circuit serves to introduce the hydraulic selectively supplied to retardation angle side oil chambers 9 or advance angle side oil chambers 10 via a predetermined oil hole into lock hole 31. It is noted that hydraulic circuit 4 constitutes this release purpose hydraulic circuit.

A positioning section is disposed between housing member 11 and rear plate 13 to perform a rotational positioning of housing member 11 and rear plate 13, namely, a rotational positioning of tip portion 30*a* of lock piston 30 and lock hole 31, when each component of housing member 11, front cover 12, and rear plate 13 is assembled by means of bolts 14.

Figure 2:
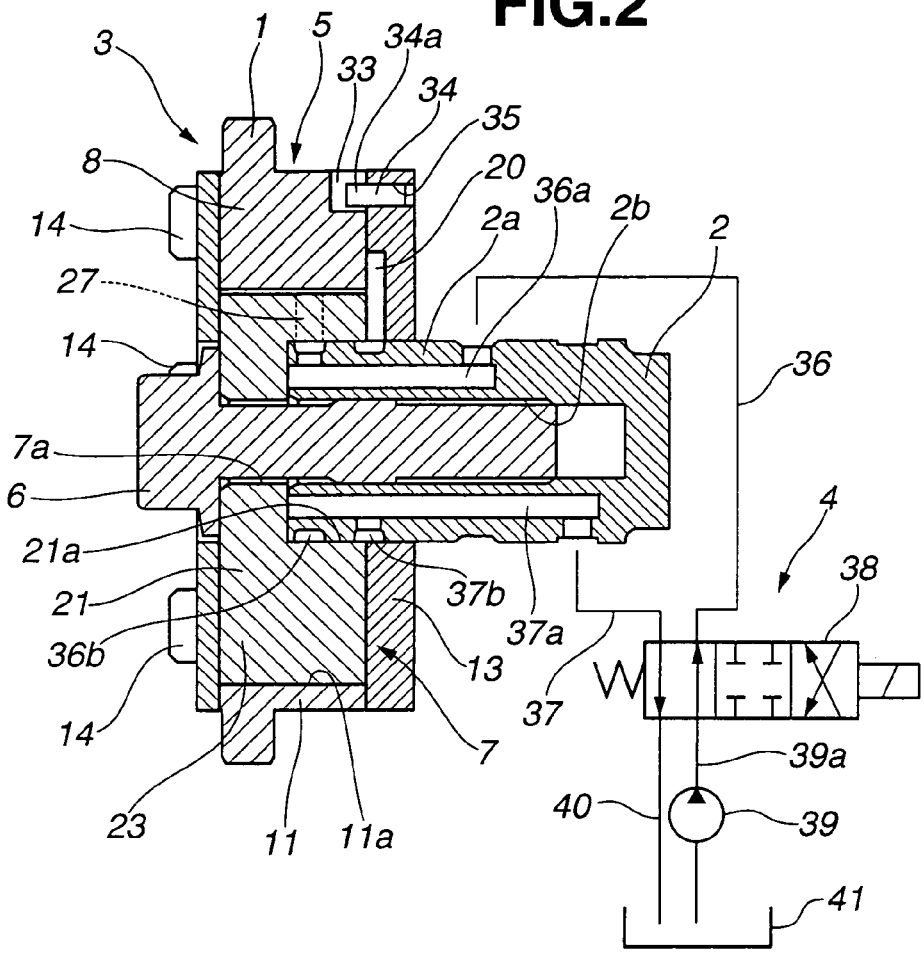
FIG. 2 is a rough partial cross sectional view representing an inner side of the valve timing control apparatus and a hydraulic circuit in the first preferred embodiment according to the present invention.
Figure 3:
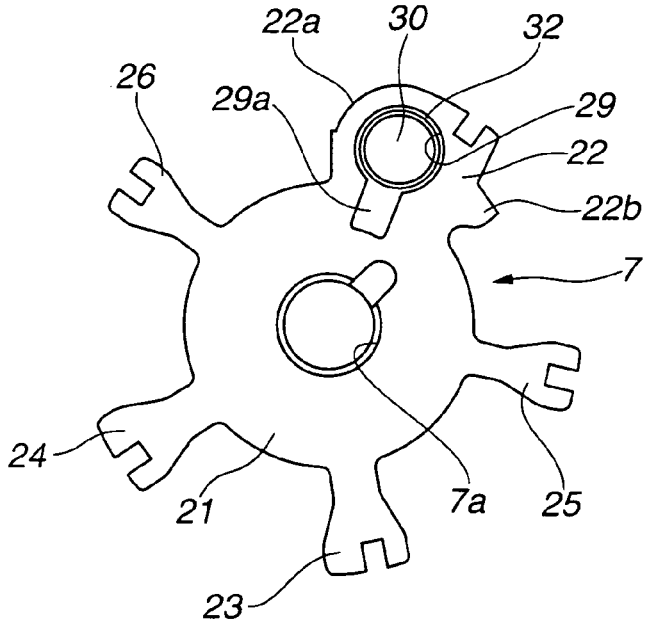
FIG. 3 is a plan view representing a vane member used in the first preferred embodiment of the valve timing control apparatus shown in FIG. 1.

That is to say, this positioning section, as typically shown in FIGS. 1 and 2, includes: a positioning recess portion 33 cut out at a predetermined position of an outer peripheral edge of housing member 11 faced toward rear plate 13; and a positioning pin 34 which is a positioning convex portion installed at a position of the outer peripheral portion of rear plate 13 corresponding to positioning recess portion 33.

That is to say, positioning recess portion 33 is formed in a substantially rectangular groove shape at a center position in a circumferential direction of raise portion 18 of housing member 11 from the outer peripheral surface along the outer end surface side of rear plate 13 and formed simultaneously during a sintered die molding of housing member 11.

On the other hand, positioning pin 34 is press fitted into a pin hole 35 penetrated axially in the vicinity to lock hole 31 at the outer peripheral side of rear plate 13 and axially engageably inserted positioning recess portion 33 with its tip portion 34*a* (typically shown in FIG. 2) projected toward housing member 11. It is noted that a width of positioning recess portion 33 is set t6o be slightly larger than an outer diameter of positioning pin 34 and is set so that a circumferential deviation between housing member 11 and rear plate 13 does not occur in the relationship to the engageably inserted positioning pin 34.

Hydraulic circuit 4 serves to supply selectively the hydraulic pressure to respective oil chambers 9, 10 or drain (exhaust) selectively the hydraulic pressure from respective oil chambers 9, 10. Hydraulic circuit 4, as shown in FIG. 2, includes: a retardation angle passage 36 which is communicated with retardation angle side oil hole 27; an advance angle passage 37 which is communicated with each advance angle side oil groove 20; an oil pump 39 which selectively supplies the hydraulic to each passage 36, 37 via an electromagnetic switching valve 38; and a drain passage 40 which is selectively communicated with each passage 36, 37 via electromagnetic switching valve 38.

Both passages 36, 37 are communicated with respective oil grooves 20 and respective oil holes 27 via oil passage holes 36*a*, 37*a* and grooves 36*b*, 37*b* formed along the radial direction and along the axial direction within an internal portion of camshaft 2.

Electromagnetic switching valve 38 serves to perform a switch control selectively among respective passages 36, 37, a draining passage 39*a* of an oil pump 39, and a draining passage 40 in response to an output signal from a controller (not shown).

The controller includes an internal computer which inputs information signals from various kinds of sensors of a crank angle sensor, an airflow meter, a coolant temperature sensor, a throttle valve opening angle sensor (not shown), and so forth, detects a present engine driving condition, and outputs a control pulse current to an electromagnetic coil of electromagnetic switching valve 38 in accordance with the detected engine driving condition.

Next, an action of the valve control apparatus in the first embodiment will be described below. When the engine is started, tip portion 30*a* of lock piston 30 is previously inserted into lock hole 31 as shown in FIG. 4 so as to constrain vane member 7 into a position of the retardation angle side which is optimum to the engine start. Therefore, when an ignition switch is turned to ON and the engine is started, a smooth cranking occurs so that a favorable start characteristic can be achieved.

Then, in a predetermined low engine speed and low load region after the engine is started, a power supply from controller to the electromagnetic coil of electromagnetic switching valve 38 is interrupted. Thus, at the same time when advance angle side passage 37 is communicated from draining passage 39*a*, retardation angle side passage 36 and draining passage 40 are communicated.

Thus, a working oil drained from oil pump 39 is streamed into advance angle side oil chambers 10 via advance angle side passage 37 so that the hydraulic pressure in advance angle side oil chambers 10 becomes high. On the other hand, the working oil within retardation angle oil chambers 9 is drained into an oil pan 41 from draining passage 40 via retardation angle side passage 36 so that the hydraulic pressure within retardation angle side oil chambers 9 becomes lowered.

At this time, the working oil flowing into advance angle oil chamber 10 is caused to flow into lock hole 31 so that lock piston 30 is retarded and pulled out of lock hole 31. Thus, vane member 7 secures a free rotation.

Hence, along with an expansion of a volume in advance angle oil chambers 10, vane member 7 is rotated in the clockwise direction as shown in FIG. 5. Hence, the relative rotation angle of camshaft 2 is converted into the advance angle side with respect to sprocket 1.

On the other hand, in a case where the engine is transferred, for example, into a high rotation and high load region, a control current is outputted from the controller to electromagnetic switching valve 38 so that draining passage 39*a* is communicated with retardation angle side passage 36 and, at the same time, advance angle side passage 37 is communicated with draining passage 40. Thus, the working oil within advance angle oil chamber 10 is drained so as to provide the low hydraulic pressure and the working oil is supplied within retardation angle side oil chamber 9 so as to provide the high hydraulic pressure within retardation angle side oil chamber 9. At this time, the hydraulic pressure is supplied from retardation angle side oil chamber 9 within lock hole 31. Hence, lock piston 30 is maintained at a state in which lock piston 30 is pulled out of lock hole 31.

Thus, vane member 7 is rotated in a counterclockwise direction with respect to housing 5, as shown in FIG. 4, for the relative rotation phase with respect to sprocket 1 to be converted into the retardation angle side.

Consequently, the open and closure timings of the intake valve are controlled to be in the retardation angle side so that an engine output in the high engine speed and high load region can be raised.

In addition, at a time immediately before the engine stops, the supply of the hydraulic pressure toward respective oil chambers 9, 10 is halted and an alternating torque acted upon camshaft 2 causes vane member 7 to make a relative rotation toward retardation angle side. Thus, lock piston 30 advances (projects) due to a spring force of coil spring 32 so that tip portion 30*a* of lock piston 30 is engaged within lock hole 31. In this case, as will be described later, during the assembly of each component, since an accurate positioning of piston 30 and lock hole 31 in a circumferential direction of housing 5 is carried out, a smooth engagement action of lock piston 30 with lock hole 31 can be achieved.

That is to say, in this embodiment, during the assembly of each component, front cover 12 and rear plate 13 are assembled onto housing member 11 by means of respective bolts 14. Front cover 12 is previously assembled onto front end side of housing member 11 by means of respective bolts 14, rear plate 13 is disposed on the rear end portion of housing member 11, and the positioning pin 34 is engaged with positioning recess 33 of housing member 11 from the axial direction.

At this time, while lock piston 30 and coil spring 32 are housed within slide hole 29, tip portion 30*a* of lock piston 30 is previously engaged within lock hole 31 of rear plate 13.

Thereafter, with tip male screws of respective bolts 14 screwed into respective female screw holes 13*a* of rear plate 13, each bolt 14 is directly tightened so that both of front and rear plates 12, 13 can firmly be coupled to housing member 11 and the accurate positioning of rear plate 13 in the circumferential direction with respect to housing member 11 can be carried out.

Hence, even if the positioning error occurs between each bolt 14 and each bolt penetrating hole 17 of housing member 11, the accurate positioning of lock piston 30 and lock hole 31 in the circumferential direction of housing 5 can become possible.

Consequently, a smooth engagement action of lock piston 30 with respect to lock hole 31 during the engine stop can be achieved. In addition, for example, during the drive of the engine, the circumferential positional error between lock piston 30 and lock hole 31 due to the rotational torque acted upon housing member 11 from a rotation transmitting member can be prevented.

In addition, since positioning recess portion 33 and positioning pin 34 are formed on rear plate 13 on which housing member 11 in which lock piston 30 is formed and lock hole 31 are formed, respectively, the positioning accuracy between lock piston 30 and lock hole 31 during the assembly can be improved.

In addition, in this embodiment, housing member 11 can secure a sufficient volume for a relative rotation conversion torque between housing 5 and vane member 7 by means of five oil chambers 9, 10 partitioned by means of five vanes 22 through 26, its axial length of housing member 11 can be shortened as short as possible Consequently, since the axial length of the whole apparatus can be shortened, an engine mountability of an engine type in which the engine is laterally mounted in an engine compartment can be improved and a degree of freedom of a layout can be improved.

In addition, since cutout portion 22*a* is formed only at the tip surface of first vane 22 having the maximum length and faced against one side surface of shoe 8, the width of first vane 22 can be as small as possible even if the seal groove is formed on the tip surface of vane 22 located at opposite side to the one side surface. Consequently, a relative conversion angle between housing 5 and vane member 7 can be enlarged (widened). Furthermore, since positioning recess portion 33 is installed on raise portion 18 of shoe 8 of housing member 11, a space of raise portion 18 can effectively be utilized. Cutout portion 22*a* and outer side surface 18*a* of raise portion 18 are formed respectively in arc shapes. A right angle contact is prevented and a strength of first vane 22 can be assured.

Since housing member 11 is formed of the relatively high hardness material in terms of a durability, it becomes difficult to perform a hole punching by means of a drilling at that position. However, in this embodiment, positioning recess portion 33 can be formed together with housing member 11 by means of a die forming. Hence, a forming operation becomes easy.

Furthermore, since positioning pin 34 and positioning recess portion 33 are disposed at a position sufficiently near to lock hole 31, the positioning accuracy of lock piston 30 and lock hole 31 can furthermore be increased.

Figure 6:
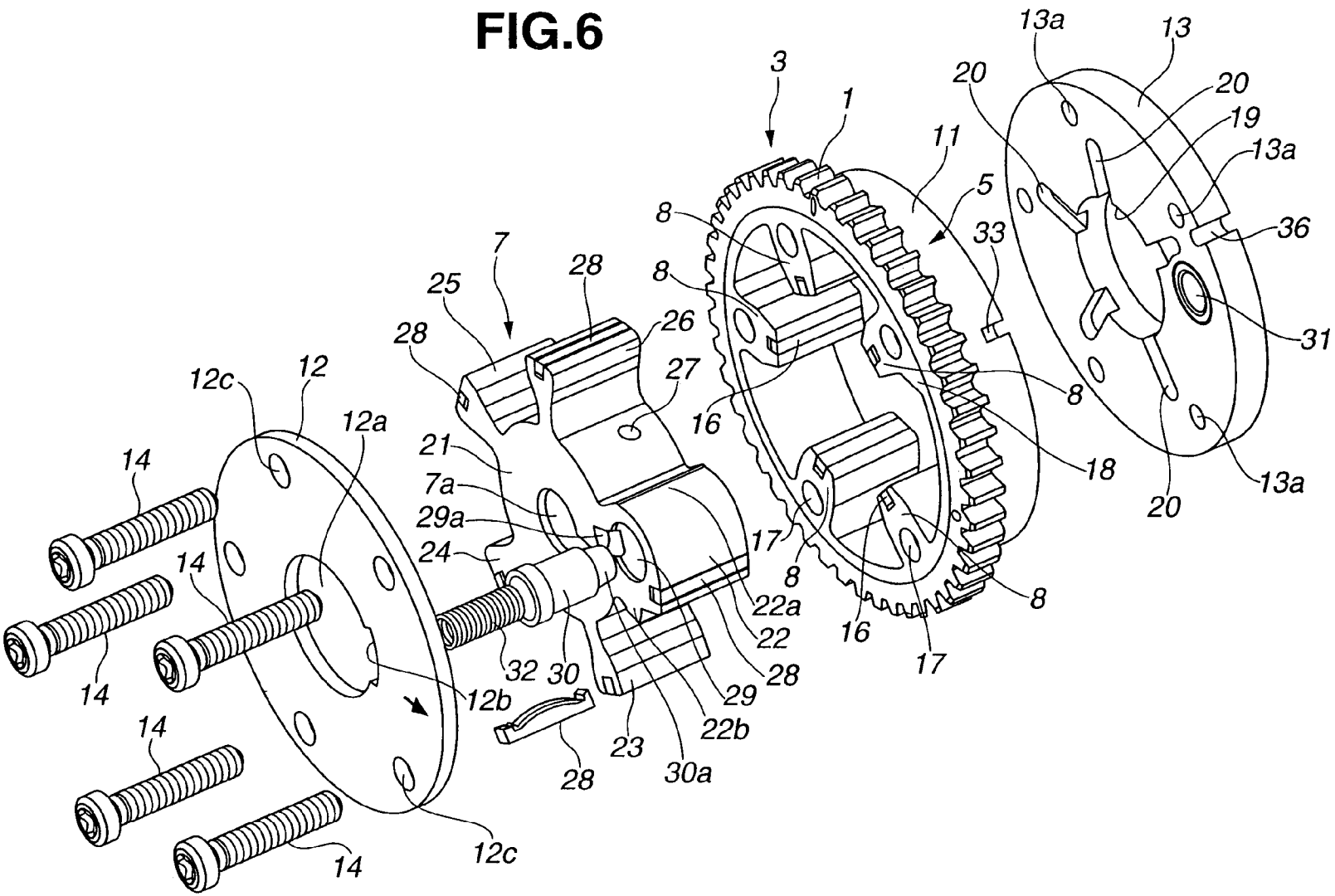
FIG. 6 is an exploded perspective view of the valve timing control apparatus in a second preferred embodiment according to the present invention.

FIG. 6 shows a second preferred embodiment of the valve timing control apparatus according to the present invention. In the second embodiment, the structure of the positioning section is modified. First positioning recess portion 33 formed on housing member 11 is the same as the first embodiment. However, in place of the positioning pin of rear plate 13, a second positioning recess portion 36 is formed. These positioning recess portions 33, 36 are positioned so as to make a positioning to each other by means of a positioning jig 37.

Specifically explaining, second positioning recess portion 36 is penetrated and formed in the axial direction on an outer peripheral edge in lock hole 31 of rear plate 13 and cut out in an approximately letter U shape.

Figure 7:
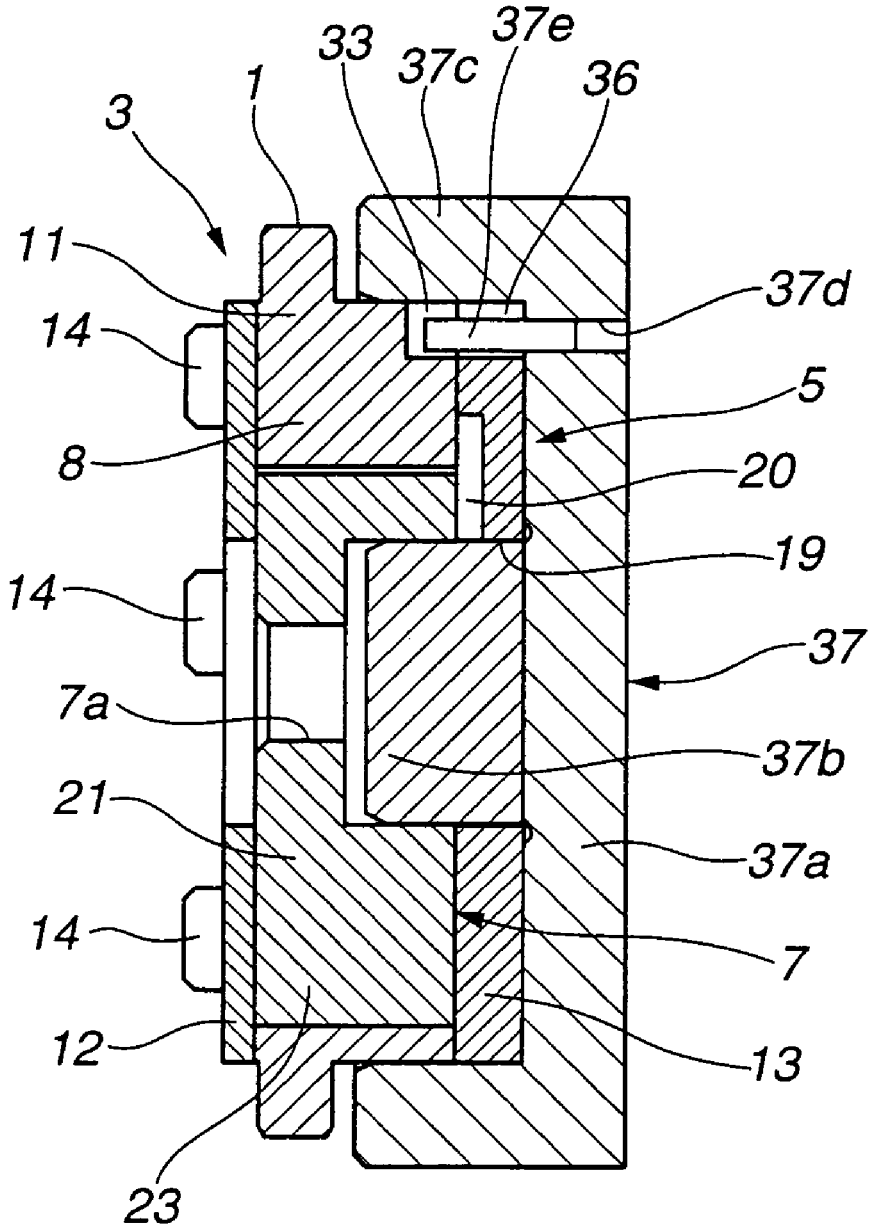
FIG. 7 is a longitudinal cross sectional view representing an assembly operation of components constituting the valve timing control apparatus in the second embodiment shown in FIG. 6.

Positioning jig 37 is formed in a substantially bottom present annular shape, as shown in FIG. 7. Positioning jig 37 includes: a bottom portion 37*a*; an approximately cylindrical projection 37*b* fitted from the axial direction into fitting groove 21*a* of vane rotor 21 during the assembly; an annular peripheral wall 37*c* fitted onto an outer peripheral surface of rear plate 13 and an outer peripheral surface of the end portion of housing member 11 during the assembly; and a positioning pin 37*e* press fitted into a fixture purpose hole 37 penetrated in the proximity to peripheral wall 37*c* of bottom portion 37*a*.

Hence, during the assembly of front cover 12 and rear plate 13 onto housing member 11, the same procedure as the first embodiment is basically carried out. When rear plate 13 is arranged at the rear end of housing member 11, the positions of both positioning recess portions 33, 36 are previously mated with each other and, thereafter, as shown in FIG. 7, when projection 37*b* of positioning jig 37 and peripheral wall 37*c* provide means for fitting onto rear plate 13 and housing member 11, positioning pin 37*e* is fitted into second positioning recess 36 from the outer axial direction and directly fitted into first positioning recess 33.

Under the above described state, each bolt 14 is fastened, a circumferential positioning of rear plate 13 to the housing member 11 can be assured. Consequently, an accurate positioning between lock piston 30 and lock hole 31 can be made. It is noted that, after the assembly thereof (operation)

is finished, positioning jig 37 is removed from positioning recess portions 33, 36 from the axial direction.

Hence, according to this preferred embodiment of the present invention, the same action and advantages as the first embodiment can be achieved. Then, merely by forming second positioning recess portion 36 on rear plate 13, it is not necessary to install the positioning pin 34. Hence, a reduction of a manufacturing cost can be achieved.

It is noted that a structure of positioning jig 37 may furthermore be simplified, for example, such a tool as a flat head screwdriver may be utilized. Or alternatively, without use of these jigs, it is possible to visually recognize the positioning of both of first and second positioning recess portions 33, 36.

This application is based on a prior Japanese Patent Application No. 2004-252256 filed in Japan on Aug. 31, 2004. The entire contents of the Japanese Patent Application No 2004-252256. are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A valve timing control apparatus for an internal combustion engine, comprising:

a housing comprising a cylindrical housing member, a front cover, and a rear plate, both of the front cover and the rear plate enclosing openings of both ends of the housing member and being integrally coupled to the housing member by a plurality of fastening members to constitute the housing;

a rotation transmitting member to transmit a torque from an engine crankshaft to the housing;

at least one shoe projected from an inner peripheral surface of the housing member;

a vane member rotatably arranged within the housing to partition an inner space of the housing into an advance angle oil chamber and a retardation angle oil chamber by at least one vane extended radially and the shoe;

a seal member fitted into a seal groove formed on a tip surface of the vane and slidably contacted with the inner peripheral surface of the housing member;

a lock piston retractably projected from an inner part of the vane;

a part of one of the front cover and the rear plate comprising a lock hole to restrain a relative rotation between the vane member and the housing when the lock piston is projected and is inserted into the lock hole;

an engagement-and-disengagement mechanism that causes an engagement and a release of the engagement of the lock piston with the lock hole in accordance with an engine start; and a positioning section, interposed between a predetermined position of the housing member at which the shoe is positioned so as to be opposed against a side surface of the vane in which the lock piston is arranged and one of the front cover and rear plate on which the lock hole is formed, to perform a housing circumferential directional positioning of the lock piston and the lock hole, the positioning section comprising: a positioning convex portion installed on one of the front cover, the rear plate, and the housing member; and a positioning recess portion installed on one of the remaining two of the front cover, the rear plate, and the housing member to engage with the positioning convex portion to perform the housing circumferential positioning of the lock piston and the lock hole, a cutout portion being formed on at least a side surface of a tip portion of the vane in which the lock piston is installed opposed against the shoe, a raise portion being formed on a side portion of the shoe opposed against the cutout portion, one of the positioning convex portion and the positioning recess portion being installed on a side of the raise portion of the shoe of the housing member, and the other of the positioning convex portion and the positioning recess portion being installed on one of the front cover and the rear plate on which the lock hole is formed.

2. A valve timing control apparatus for an internal combustion engine as claimed in claim 1, wherein the lock piston is formed in an approximately cylindrical pin shape, the cutout portion is formed in an arc shape which is approximately analogous to a contour of the lock piston, and an outside surface of the raise portion of the shoe opposed against the cutout portion is formed in the arc shape which is approximately of the same shape as the cutout portion.

3. A valve timing control apparatus for an internal combustion engine as claimed in claim 1, wherein the positioning recess portion is formed on the housing member and the positioning convex portion is pressed into a pin hole drilled through one of the front cover and the rear plate.

4. A valve timing control apparatus for an internal combustion engine as claimed in claim 1, wherein the housing member on which the positioning recess portion is formed is hardened to a high hardness housing member by a heat treatment.

5. A valve timing control apparatus for an internal combustion engine as claimed in claim 3, wherein the housing member is formed of a material having a higher hardness than one of the front cover and the rear plate on which the pin is installed.

6. A valve timing control apparatus for an internal combustion engine as claimed in claim 3, wherein the housing member is formed by sintering and the positioning recess portion is simultaneously formed during a die forming of the housing member.

7. A valve timing control apparatus for an internal combustion engine as claimed in claim 3, wherein the positioning recess portion is cut out in a groove shape from an outer peripheral edge of the housing member.

8. A valve timing control apparatus for an internal combustion engine as claimed in claim 3, wherein an oil groove to supply and exhaust working oil to and from the advance angle oil chamber and the retardation angle oil chamber is formed on one of the front cover and the rear plate on which the pin is installed.

9. A valve timing control apparatus for an internal combustion engine as claimed in claim 1, wherein the lock hole is formed at a position of the housing deviated toward the circumferential direction of the housing, the lock piston is formed at a position deviated toward the lock hole of the vane, and one of the positioning convex portion and the positioning recess portion is formed in a proximity of the lock hole.

10. A valve timing control apparatus for an internal combustion engine as claimed in claim 1, wherein the seal member installed on a tip surface of the vane in which the lock piston is arranged is formed on the tip surface of the vane opposite to the raise portion of the shoe.

11. A valve timing control apparatus for an internal combustion engine as claimed in claim 1, wherein the rotation transmitting member is formed integrally on the housing member.

12. A valve timing control apparatus for an internal combustion engine as claimed in claim 1, wherein one of the front cover and the rear plate on which the pin is installed is made by a press forming.

13. A valve timing control apparatus for an internal combustion engine as claimed in claim 1, wherein the vane member is provided with five sheets of vanes and five shoes.

14. A valve timing control apparatus for an internal combustion engine as claimed in claim 13, wherein, when one of the vanes in which the lock piston is arranged is contacted with one of both sides of the shoes, the other vanes are not contacted with the both sides of the shoes.

15. A valve timing control apparatus for an internal combustion engine as claimed in claim 14, wherein a projection is formed on a side surface opposite to the cutout portion of the one of the vanes in which the lock piston is arranged.

16. A valve timing control apparatus for an internal combustion engine as claimed in claim 13, wherein a seal groove is formed at a tip of each of the shoes along an axial direction of the housing and a seal member is fitted into the seal groove.

17. A valve timing control apparatus for an internal combustion engine as claimed in claim 1, wherein, when the vane on which the cutout portion is formed is contacted with the shoe on which the raise portion is formed, the cutout portion and the raise portion are faced against each other via a gap.

18. A valve timing control apparatus for an internal combustion engine, comprising:

a housing comprising a cylindrical housing member, a front cover, and a rear plate, both of the front cover and the rear plate enclosing openings of both ends of the housing member and being integrally coupled to the housing member by a plurality of fastening members to constitute the housing;

a rotation transmitting member to transmit a torque from an engine crankshaft to the housing;

at least one shoe projected from an inner peripheral surface of the housing member;

a vane member rotatably arranged within the housing to partition an inner space of the housing into an advance angle oil chamber and a retardation angle oil chamber by at least one vane extended radially and the shoe;

a seal member fitted into a seal groove formed on a tip surface of the vane and slidably contacted with the inner peripheral surface of the housing member;

a lock piston retractably projected from an inner part of the vane;

a part of one of the front cover and the rear plate comprising a lock hole to restrain a relative rotation between the vane member and the housing when the lock piston is projected and is inserted into the lock hole;

an engagement-and-disengagement mechanism that causes an engagement and a release of the engagement of the lock piston with the lock hole in accordance with an engine start; and a positioning section, interposed between a predetermined position of the housing member at which the shoe is positioned so as to be opposed against a side surface of the vane in which the lock piston is arranged and one of the front cover and rear plate on which the lock hole is formed, to perform a housing circumferential directional positioning of the lock piston and the lock hole, the positioning section comprising:

a first positioning recess portion installed on one of the front cover, the rear plate, and the housing member; and a second positioning recess portion installed on one of the remaining two of the front cover, the rear plate and the housing member so as to face toward the first positioning recess portion, wherein a cutout portion is formed on a side surface of a tip portion of the vane in which the lock piston is installed which is faced toward the shoe, a raise portion is formed on the side surface of the tip portion of the shoe faced toward the cutout portion, one of the first and second positioning recess portions is installed on a side of the raise portion of the shoe of the housing member, and the other of the first and second positioning recess portions is installed on one of the front cover and the rear plate on which the lock hole is formed.

19. An assembling method for a valve timing control apparatus for an internal combustion engine, the valve timing control apparatus comprising:

a housing comprising a cylindrical housing member, a front cover, and a rear plate, both of the front cover and the rear plate enclosing openings of both ends of the housing member and being integrally coupled to the housing member by a plurality of fastening members to constitute the housing;

a rotation transmitting member to transmit a torque from an engine crankshaft to the housing;

at least one shoe projected from an inner peripheral surface of the housing member;

a vane member rotatably arranged within the housing to partition an inner space of the housing into an advance angle oil chamber and a retardation angle oil chamber by at least one vane extended radially and the shoe;

a seal member fitted into a seal groove formed on a tip surface of the vane and slidably contacted with the inner peripheral surface of the housing member;

a lock piston retractably projected from an inner part of the vane;

a part of one of the front cover and the rear plate comprising a lock hole to restrain a relative rotation between the vane member and the housing when the lock piston is projected and is inserted into the lock hole;

an engagement-and-disengagement mechanism that causes an engagement and a release of the engagement of the lock piston with the lock hole in accordance with an engine start; and a positioning section, interposed between a predetermined position of the housing member at which the shoe is positioned so as to be opposed against a side surface of the vane in which the lock piston is arranged and one of the front cover and rear plate on which the lock hole is formed, to perform a housing circumferential directional positioning of the lock piston and the lock hole, the positioning section comprising: a first positioning recess portion installed on one of the front cover, the rear plate, and the housing member; and a second positioning recess section installed on one of the remaining two of the front cover, the rear plate, and the housing member so as to face toward the first positioning recess portion, a cutout portion being formed on a side surface of a tip portion of the vane in which the lock piston is installed which is faced toward the shoe, a raise portion being formed on the side surface of the tip portion of the shoe faced toward the cutout portion, one of the first and second positioning recess portions being installed on a side of the raise portion of the shoe of the housing member, and the other of the first and second positioning recess portions being installed on one of the front cover and the rear plate on which the lock hole is formed, the assembling method comprising:

fitting a positioning jig into the first and second positioning recess portions to perform the housing circumferential positioning, during the assembly of the front cover and the rear plate onto the housing member; and removing the positioning jig from the first and second positioning recess portions after the assembly of the front cover and the rear plate onto the housing member is finished.

* * * * *